US006220003B1

(12) United States Patent
Hung

(10) Patent No.: US 6,220,003 B1
(45) Date of Patent: Apr. 24, 2001

(54) GIRTH HAVING BREATHABLE STRUCTURE

(76) Inventor: Kuei Yin Hung, P.O. Box 63-99, Taichung, 406 (TW)

( * ) Notice: Subject to any disclaimer, the term of this patent is extended or adjusted under 35 U.S.C. 154(b) by 0 days.

(21) Appl. No.: 09/407,611

(22) Filed: Sep. 28, 1999

(51) Int. Cl.[7] ..... B68C 1/14
(52) U.S. Cl. ..... 54/23
(58) Field of Search ..... 54/4, 23, 35

(56) References Cited

U.S. PATENT DOCUMENTS 3,828,521 * 8/1974 Dulaney ..... 54/23
5,426,924 * 6/1995 Harty ..... 54/23
5,743,072 * 4/1998 Chang ..... 54/23
5,946,892 * 9/1999 Siddoway ..... 54/23

* cited by examiner

*Primary Examiner*—Robert P. Swiatek

(57) ABSTRACT

A girth for a horse includes a cover device having a base member and having a number of orifices for air circulation purpose. A fastener strap device is secured to the cover device and includes two buckles secured to the ends and engaged on the base member which is engaged between the horse and the buckles for separating the buckles from the horse and for preventing the buckles from hurting the horse. The fastener strap device includes an envelope having a chamber for receiving fiber materials. Two backing pads are secured between the buckles and the base member.

8 Claims, 4 Drawing Sheets

GIRTH HAVING BREATHABLE STRUCTURE

BACKGROUND OF THE INVENTION

1. Field of the Invention

The present invention relates to a girth, and more particularly to a girth having a breathable structure.

2. Description of the Prior Art

Typical girths for horses are made of cloth materials which may absorb the sweat of the horses and may slip relative to the abdominal portions of the horses such that the horses may feel uncomfortable.

The present invention has arisen to mitigate and/or obviate the afore-described disadvantages of the conventional girths.

SUMMARY OF THE INVENTION

The primary objective of the present invention is to provide a girth including a breathable structure for air circulation purposes and for preventing the girth from absorbing the sweat of the horse, and including an anti-slip structure for preventing the girth from moving relative to the horse and from hurting or scrubbing the horse.

In accordance with one aspect of the invention, there is provided a girth for a horse comprising a cover device including a base member having a substantially open mesh structure characterized by a plurality of through openings, the openings having a cross-sectional area significantly larger than the diameter of horse hair, for permitting air circulation and moisture penetration while avoiding the gripping or wedging of horse hairs within the through-openings in the mesh, the base member including two ends, a fastener strap device secured to the cover device, the fastener strap device including two ends, and two buckles secured to the ends of the fastener strap device and engaged on the ends of the base member of the cover device. The ends of the base member of the cover device are provided between the horse and the buckles for separating the buckles from the horse and for preventing the buckles from hurting the horse.

The cover device further includes a cover member having two sides secured to the base member and having a length shorter than that of the base member for allowing the ends of the base member to be extended outward beyond the cover member, and a space is formed between the cover member and the base member for receiving the fastener strap device.

The fastener strap device includes an envelope having a chamber for receiving fiber materials and having two ends secured to the buckles. Two backing pads are secured to the ends of the fastener strap device and engaged between the buckles and the ends of the base member of the cover device.

The cover device includes a middle portion, the girth further includes a connecting strap engaged around and secured to the middle portion of the cover device and the fastener strap device, and at least one ring secured to the connecting strap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
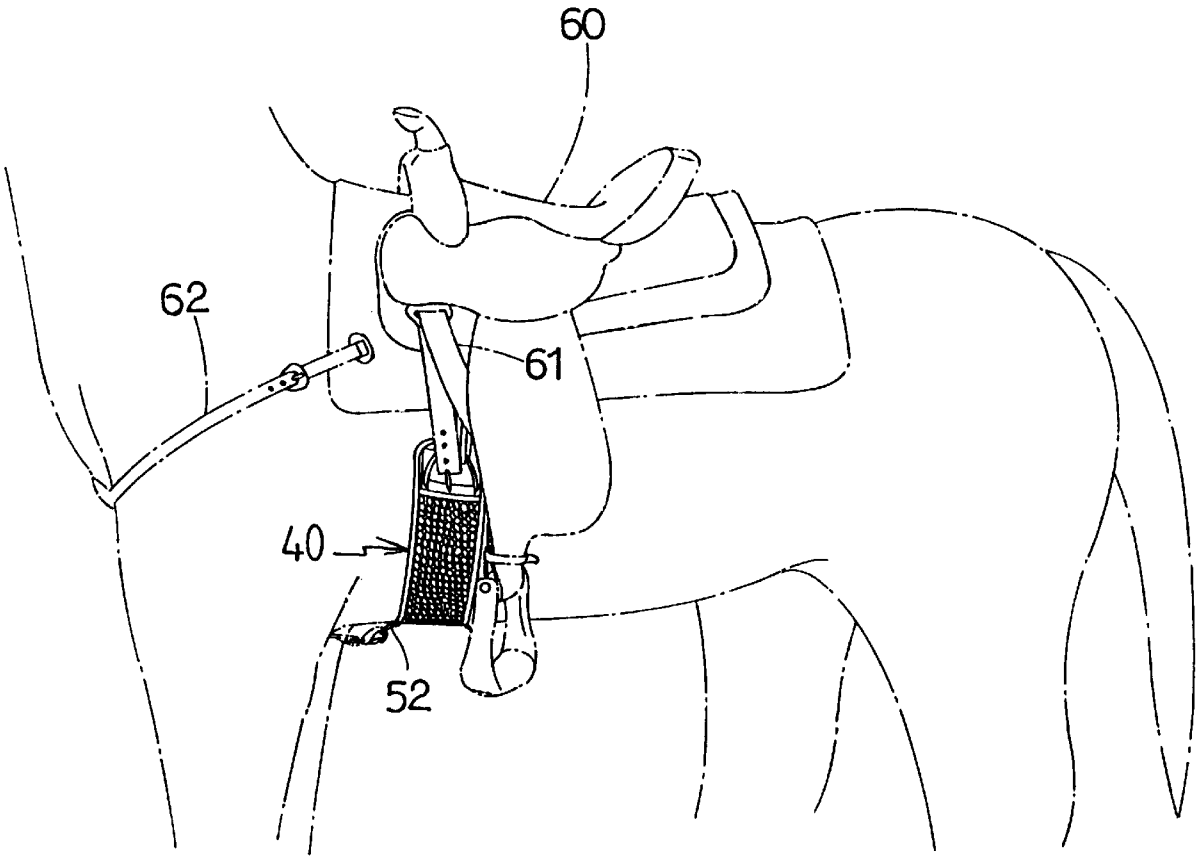
FIG. 1 is an schematic view illustrating the attachment of a girth in accordance with the present invention to the abdominal portion of the horse.

Referring to the drawings, and initially to FIG. 1, a girth in accordance with the present invention is shown in solid lines in FIG. 1 and is provided for attaching onto the abdominal portion of the horse and for securing to the saddle 60 by fastener straps 61, 62.

Referring next to FIGS. 2–5, the girth comprises a fastener strap device 10 secured to a cover device 40 for forming the girth. The fastener strap device 10 includes an open-mesh material 12 defining a plurality of through openings therein, the material 12 preferably having a coating thereon that smoothes the peripheral edges of the through openings so as to reduce the probability that horse hairs will become wedged or gripped within the openings. For this purposes, the cross-sectional area of the through openings is made to be greater than the cross-sectional area of horse hair so as to substantially reduce the possibility that horse hairs projecting into the through-openings will tend to become gripped or wedged therein. The structure of the fastener strap 10 further includes two opposite sides folded to the middle portion thereof preferably in abutting or opposing, but not overlapping, relationship for forming an elongate envelope which includes a chamber formed therein for receiving a fibrous material 11, which may comprise yarn, cord, thread etc., having the capacity for "wicking" moisture through the structure of cover device 40 and away from the skin of a horse with which it is in contact. A middle band 13 is engaged onto the opposite sides or the superimposed opposed sides of the material 12 and is secured to the cloth material 12 by suitable means such as stitches. Two end bands 14 are folded and engaged onto and secured to the ends of the envelope that is formed by the folded cloth material 12, by stitches or by welding, for example. Two buckles 21 are secured to the ends of the envelope that is formed by the folded cloth material 12, by coupler straps 22, for example, by such as stitch operations. Two backing pads 30 are secured to the ends of the envelope by suitable means such as stitching and engaged with the buckles 21 for separating and for additional separation from the horse.

The fiber materials 11, the coated material 12, the bands 13, 14, the coupler straps 22, and/or the backing pads 30 are preferably made of a synthetic material such as nylon which will not absorb water and sweat; and include a number of through-openings or orifices formed therein defining a breathable structure for air circulation purposes. The backing pads 30 are provided for engaging between the buckles 21 and the horse for preventing the buckles 21 from hurting the horse.

Figures 2, 3:
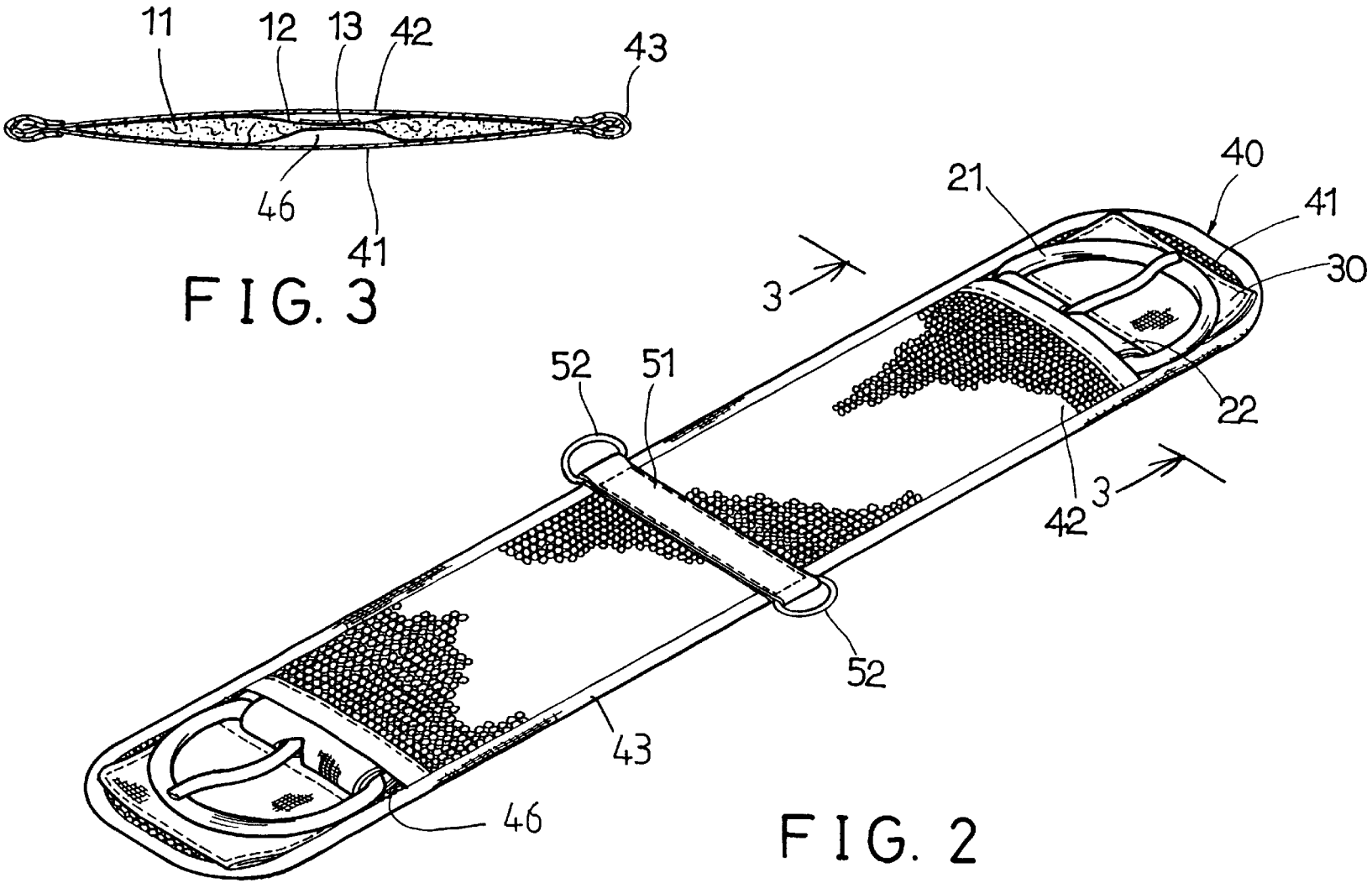
FIG. 2 is a perspective view of the girth.
FIG. 3 is a cross sectional view taken along lines 3—3 of FIG. 2.
Figure 4:
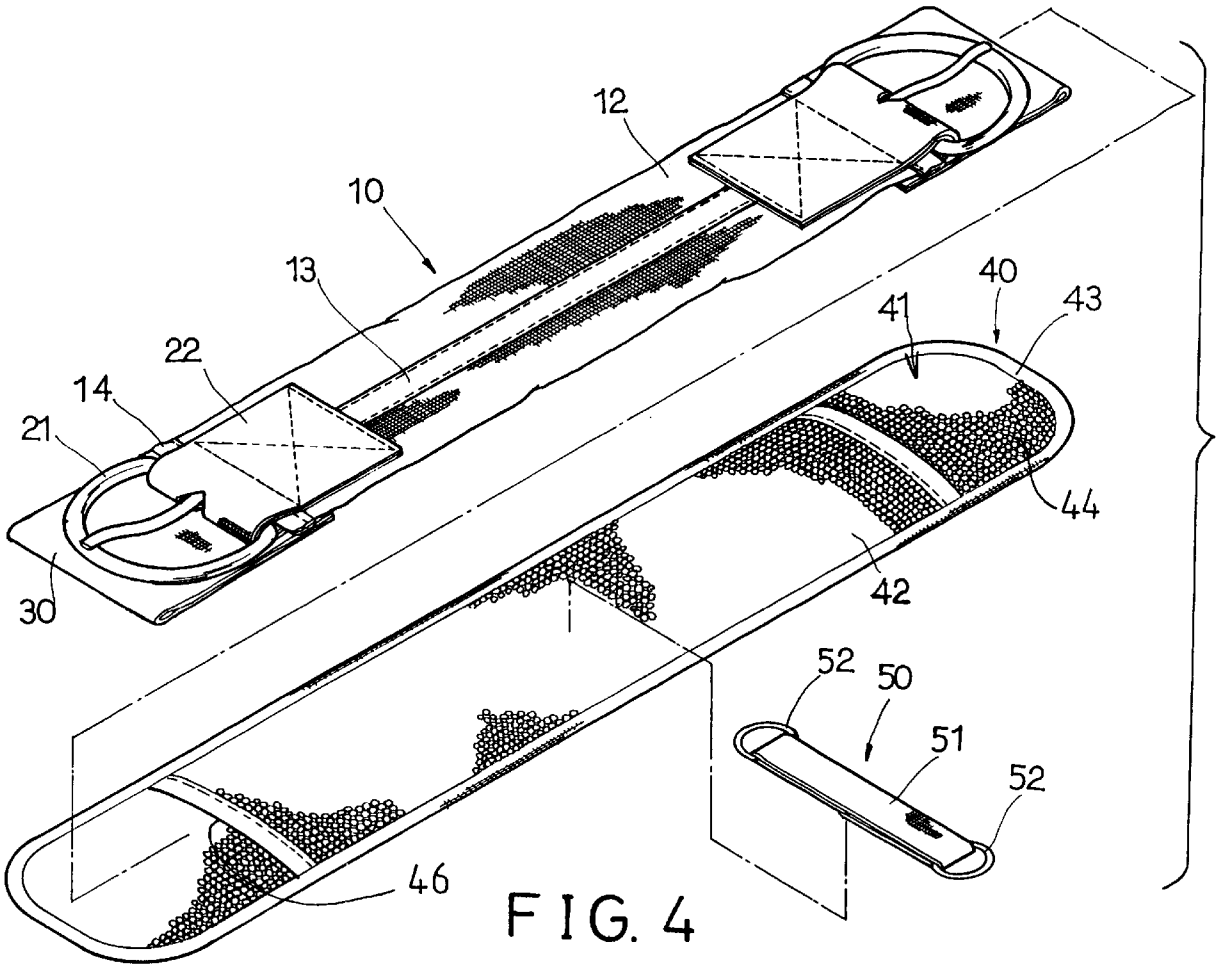
FIG. 4 is a partial exploded view of the girth.
Figure 5:
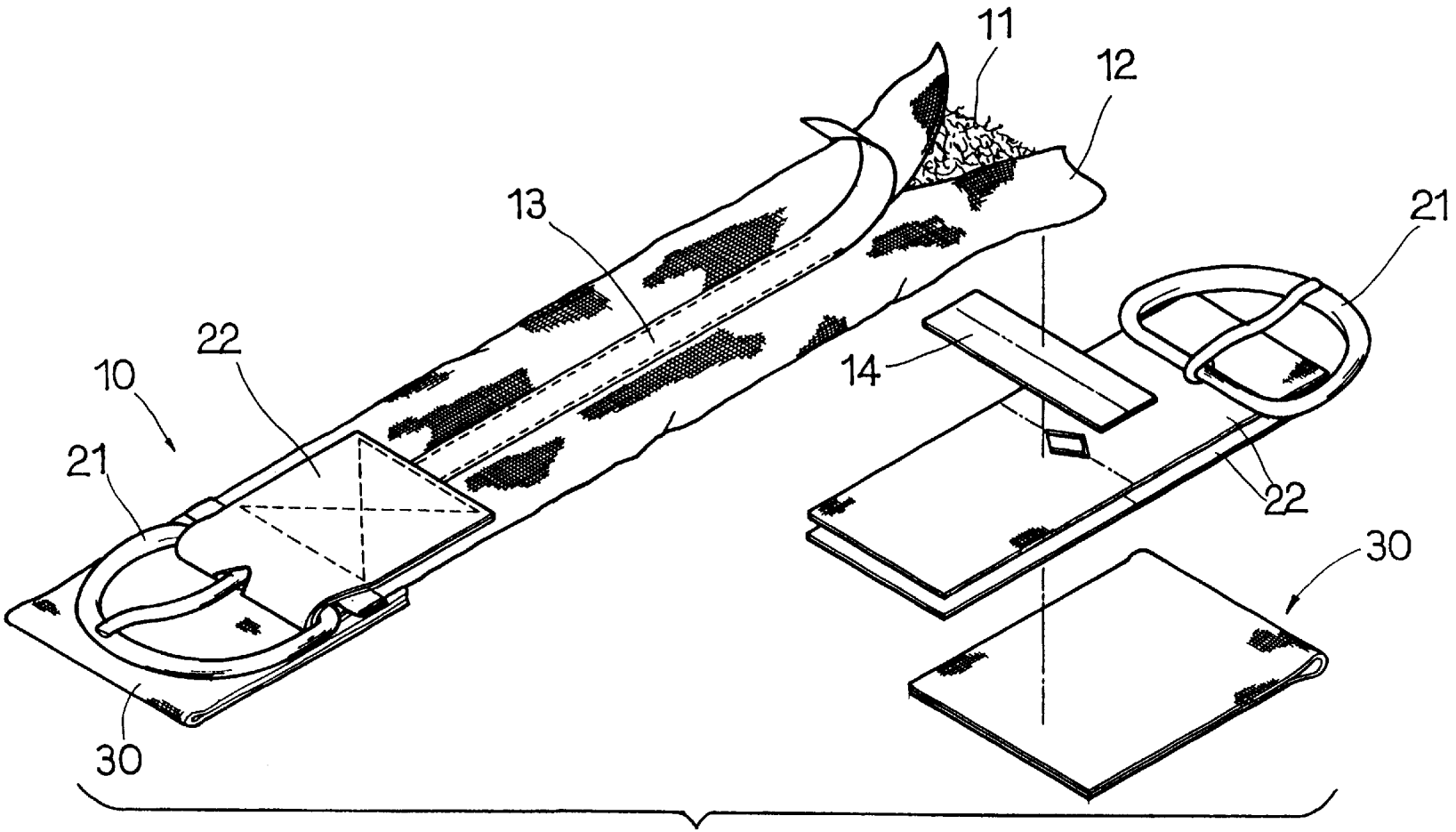
FIG. 5 is a partial exploded view of the fastener strap device of the girth.

The cover device 40 includes a base member 41 and a cover member 42, and a peripheral bead member 43 secured to the peripheral portion of the base member 41 and securing the side portions of the cover member 42 to the base member 41. The base member 41 is longer than the cover member 42 and includes two ends 44 extended outward beyond the cover member 42 for defining and forming a space 46 between the base member 41 and the cover member 42. The space 46 formed between the base member 41 and the cover member 42 of the cover device 40 serves to receive the fastener strap device 10 (FIGS. 2, 3). The fastener strap device 10 may further be secured to the cover device 40 by stitching operations, for example. The cover device 40, particularly the base member 41 of the cover device 40 is preferably formed an open mesh cloth structure having a number of smooth edged through-openings therein and having pronounced anti-slip characteristics, for example, which provide an anti-slip characteristic. The backing pads 30 are preferably engaged with the base member 41 of the cover device 40 for further separating the buckles 21 from the horse.

It is to be noted that the base member 41 of the cover device 40 may be made of rubber materials which include an anti-slip characteristic such that the girth will not slip relative to the horse and such that the horse will not be scrubbed by the girth while it is in use. The fiber materials 11, the cloth material 12, the bands 13, 14, the coupler straps 22, and/or the backing pads 30 will not absorb water and sweat and includes a breathable structure for air circulation purposes.

A connecting strap 50 includes an elongate strap element 51 having two ends folded toward the middle portion thereof and folded to laterally engage around the middle portion of the cover device 40 and secured to the cover device 40 by stitching operations, for example. Two rings 52 are secured to the connecting strap 50 and secured to the sides of the cover device 40 for coupling to the fastener straps 62 (FIG. 1) and for securing the girth to the horse.

Accordingly, the girth in accordance with the present invention includes a breathable structure for air circulation purposes and for preventing the girth from absorbing the sweat of the horse, and includes an anti-slip structure for preventing the girth from moving relative to the horse and from hurting or scrubbing the horse.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A girth for a horse comprising:

a cover device including a base member having a plurality of orifices formed therein for air circulation purpose, said base member including two ends, a fastener strap device secured to said cover device, said fastener strap device including two ends, and said fastener strap device including an envelope having a chamber formed therein and having two ends, a fiber material received in said chamber of said envelope, said two ends of said fastener strap device being located at said ends of said envelope, two buckles secured to said ends of said fastener strap device and engaged on said ends of said base member of said cover device, said ends of said base member of said cover device being positionable between a horse and said buckles for separating said buckles from the horse and for preventing said buckles from hurting the horse.

2. The girth according to claim 1, wherein said cover device further includes a cover member having two sides secured to said base member and having a length shorter than that of said base member for allowing said ends of said base member to be extended outward beyond said cover member, a space being defined between said cover member and said base member for receiving said fastener strap device.

3. The girth according to claim 1 further comprising two backing pads secured to said ends of said fastener strap device and positioned between said buckles and said ends of said base member of said cover device.

4. A girth for a horse comprising:

a cover device including a base member having a plurality of orifices formed therein for air circulation purpose, said base member including two ends, a fastener strap device secured to said cover device, said fastener strap device including two ends, and two buckles secured to said ends of said fastener strap device and engaged on said ends of said base member of said cover device, said ends of said base member of said cover device being positionable between a horse and said buckles for separating said buckles from the horse and for preventing said buckles from hurting the horse, wherein said cover device includes a middle portion, said girth further includes a connecting strap extending around, and secured to, said middle portion of said cover device and said fastener strap device, and at least one ring secured to said connecting strap.

5. A girth for a horse comprising:

a fastener strap device including two ends, two buckles secured to said ends of said fastener strap device, two backing pads secured to said ends of said fastener strap device and located relative to said buckles for positioning between said buckles and the horse for separating said buckles from the horse, a cover device including a base member secured to said fastener strap device and having a plurality of orifices formed therein for air circulation purpose, said base member including two ends located adjacent to said backing pads, said cover device including a middle portion, a connecting strap engaged around and secured to said middle portion of said cover device and said fastener strap device, and at least one ring secured to said connecting strap.

6. The girth according to claim 5, wherein said fastener strap device includes an envelope having a chamber formed therein, a fiber material received in chamber of said envelope, the said two ends of said fastener strap being located at the ends of said envelope.

7. The girth according to claim 5, wherein said cover device further includes a cover member having two sides secured to said base member and having a length shorter than that of said base member for allowing said ends of said base member to extend outward beyond said cover member, wherein a space is formed between said cover member and said base member for receiving said fastener strap device.

8. A girth for a horse comprising:

a cover device including a base member formed of an open-mesh material having a plurality of through-openings formed therein for air circulation purposes, said through openings being characterized by a cross-sectional area significantly greater than the cross-sectional area of horse hair, said base member having two opposite ends spaced apart by a given length, a cover member having two sides secured to said base member and having a given length less than the said given length of said base member for allowing said opposite ends of said base member to extend axially beyond the ends of said cover member, said cover member and said base member defining between them a space for receiving a fastener strap member, and a fastener strap device secured to said cover device, said fastener strap device having two opposite ends located adjacent to said opposite ends of said base member, said fastener strap device further having an envelope formed therein defining a chamber, wherein said chamber is filled with a fibrous material capable of wicking moisture through said through openings in said base member and away from the skin surface of a horse in contact with said base member.

* * * * *